US006477339B1

(12) United States Patent
Yano et al.

(10) Patent No.: US 6,477,339 B1
(45) Date of Patent: Nov. 5, 2002

(54) IMAGE FORMING APPARATUS WITH CURRENT DETECTOR AND VOLTAGE CONTROL BASED ON DETECTION RESULT

(75) Inventors: Hideyuki Yano; Kazuhiro Funatani, both of Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/713,231

(22) Filed: Nov. 16, 2000

(30) Foreign Application Priority Data

Nov. 19, 1999 (JP) ..... 11-330438
Nov. 9, 2000 (JP) ..... 2000-342320

(51) Int. Cl.[7] ..... G03G 15/01; G03G 15/16
(52) U.S. Cl. ..... 399/66; 399/302; 399/303
(58) Field of Search ..... 399/66, 302, 303

(56) References Cited

U.S. PATENT DOCUMENTS 5,177,549 A 1/1993 Ohtsuka et al. ..... 355/284
5,264,092 A 11/1993 Suwa et al. ..... 355/282
5,600,421 A * 2/1997 Takekoshi et al. ..... 399/66
5,953,572 A * 9/1999 Takeuchi et al. ..... 399/302
5,966,561 A * 10/1999 Yamaguchi ..... 399/66
5,974,281 A 10/1999 Fujii et al. ..... 399/66
6,026,268 A 2/2000 Shiozawa et al. ..... 399/297
6,134,415 A * 10/2000 Iwakura et al. ..... 399/303 X
6,253,038 B1 * 6/2001 Ito et al. ..... 399/66 X

* cited by examiner

*Primary Examiner*—Fred L. Braun
(74) *Attorney, Agent, or Firm*—Fitzpatrick, Cella, Harper & Scinto

(57) ABSTRACT

An image forming apparatus has a transfer material bearing member with a first image bearing member and a second image bearing member sequentially disposed along a conveying direction of the transfer material borne by the transfer material bearing member. A first voltage applying device and a second voltage applying device are positioned to apply voltages to the transfer material bearing member so that the images on the first image bearing member and the second image bearing member are sequentially superimposed and transferred onto the transfer material borne by said transfer material bearing member. A detector is located to detect a current flowing through the transfer material bearing member when a predetermined voltage is applied to an area, on which the transfer material is borne, of the transfer material bearing member before an image transfer is started, and a controller controls the first voltage and the second voltage based on a detected result of the detector.

50 Claims, 8 Drawing Sheets

IMAGE FORMING APPARATUS WITH CURRENT DETECTOR AND VOLTAGE CONTROL BASED ON DETECTION RESULT

BACKGROUND OF THE INVENTION

1. Field of the Invention

The present invention relates to an image forming apparatus using an electrophotographic process and, for example, to the image forming apparatus such as a copier, a printer, a facsimile or the like.

2. Related Background Art

In recent years, the image forming apparatuses using the electrophotographic process are making progress toward higher-speed, higher function and colorized print, and various kinds of printers, recopying machines or the like are put on the market.

Among them, the image forming apparatus of an inline system wherein a plurality of image forming sections (image forming stations) are arranged in tandem so as to form toner images of different colors and a transfer material borne on a transfer belt as transfer material conveying means, for example, such as a sheet of paper is sequentially conveyed to each image forming station and the toner images of different colors are superimposed and transferred on the transfer material is capable of forming a color image at higher speed and hence considered to be promising as a bread-and-butter product of the color printers from now on.

The apparatus of the inline system is classified into the direct transfer system for directly multi-transferring the toner images of different colors on the transfer material conveyed by the transfer belt as described above and also the intermediate transfer system for sequentially superimposing and primarily transferring the toner images of different colors onto an intermediate transfer member (an intermediate transfer belt) and then for collectively and secondarily transferring them onto the transfer material. However, to realize miniaturization and lower cost, it is advantageous to adapt the direct transfer system because of fewer components used for the apparatus.

Also, in recent years, in view of an advanced functional design of the printers, a diversity of size, thickness (basis weight) of the transfer material and sheet papers (media) usable such as rough sheet papers in addition to the necessity for a two-sided printing are more and more required. Also, it is desired that the environment where the printers are used is not limited to offices alone where air-conditioners are fully equipped, but that even in the environment such as personal offices and own homes, an output image of good quality should be obtained because of the prevalence of SOHO (small office home office).

Thus, the printers, copying machines or the like are required to have increasingly advanced functions in view of media flexibility and using environment.

However, in the case of the inline system apparatus, since the configuration is such that a transferring is performed four times on the transfer material to form a full color image by using the transfer material and the transfer belt having unsteady factors in the value of resistance due to a change in the environment (temperature, humidity), there are some cases where an image fault occurs depending on a change in the environment wherein the apparatus is placed and the type of the transfer material used.

The transfer belt is a film member where electronic conductive agent such as carbon black and ion conductive agent is added on resin for regulating resistance. In the case of the electronic conductive agent, the value of resistance becomes uneven due to dispersion fault at the time of production, while in the case of the ion conductive agent, a water content contained in the transfer belt fluctuates due to a variation in the environment to cause a variation in the value of resistance.

On the other hand, the chief ingredient of the sheet paper is a highly hygroscopic cellulose and the value of resistance largely changes depending on its hygroscopic state. For example, in a high temperature and high humidity environment (H/H environment (30° C./80%RH)) where the sheet paper absorbs the moisture, the resistance of the sheet paper is lowered to around $10^6$ Ωcm, thereby making a given charge easy to leak, while in low temperature and low humidity environment (L/L environment) (15° C./10%RH)), the value of resistance of the sheet paper is raised to around $10^{12}$ Ωcm, thereby making a charge injection hard to take place and making a charge difficult to induce.

Also, in the image forming apparatus having an automatic duplex mechanism for forming an image on two sides of the transfer material, when a toner image transferred on one side of the transfer material is fixed by a fixing device, the moisture inside the transfer material is evaporated and, at a step of transferring the toner image on the other side of the transfer material, the resistance of the transfer material is in a very high state.

In this manner, when the transferring of the toner image is performed against the transfer material such as the transfer belt having fluctuating factors of resistance, sheet paper or the like, a transfer fault occurs since a transfer current is hard to flow where the resistance is in a high state. On the contrary, when the resistance is in a low state, the transfer current flows excessively, thereby posing a problem in that the toner image transferred from a photosensitive member receives a reverse charge by an electric discharge and reverses in polarity so that it is transferred again on the photosensitive member with a transfer efficiency lowered.

Also, in the transfer portion of each image forming station, there is a problem in that the charge injection is hard to take place in the L/L environment where the resistance of the transfer material increases or when the automatic duplex mechanism is in operation and thus the transfer fault is easy to occur.

The problem similar to the transfer fault where the transfer belt has the fluctuating factors of resistance occurs also in the image forming station wherein the intermediate transfer belt having the fluctuating factors of resistance similar to the above described transfer belt is arranged along a plurality of the image forming stations and the toner images of different colors are sequentially superimposed and primarily transferred onto the intermediate transfer belt and then collectively and secondarily transferred onto the transfer material.

SUMMARY OF THE INVENTION

An object of the present invention is to provide an image forming apparatus, in which toner images on a first image bearing member and a second image bearing member are satisfactorily and sequentially transferred to a transfer material borne by a transfer material bearing member so that images of non-irregular color can be formed.

Another object of the present invention is to provide an image forming apparatus, in which toner images on a first image bearing member and a second image bearing member are satisfactorily and sequentially transferred to an intermediate transfer member so that images of non-irregular color can be formed.

Still another object of the present invention will become apparent by reading the following detailed description with reference to the accompanying drawings.

DESCRIPTION OF THE PREFERRED EMBODIMENTS

Hereinafter, the embodiments according to the present invention will be described further in detail with reference to the accompanying drawings.

(Embodiment 1)

Figure 1:
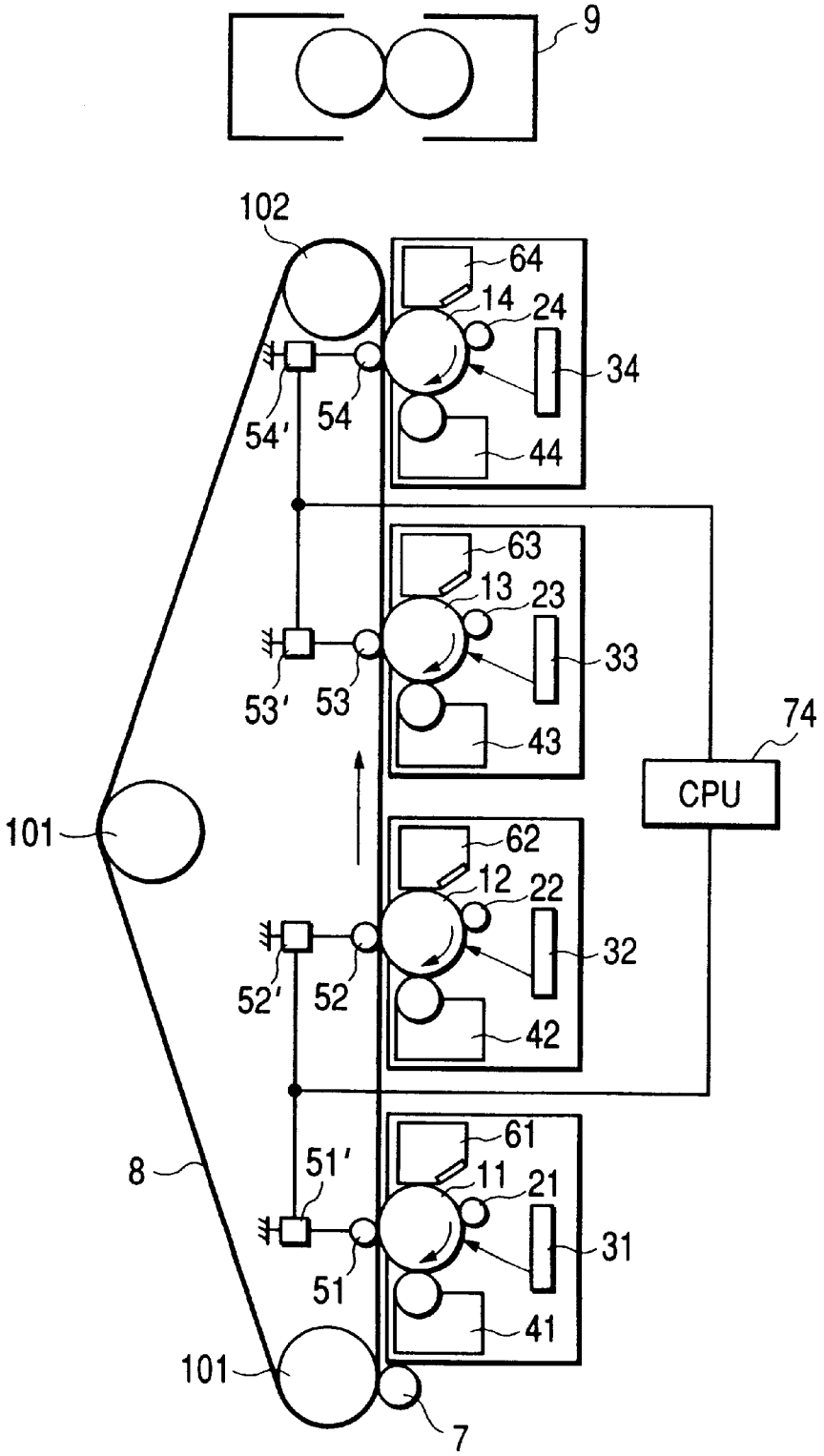
FIG. 1 is a schematic diagram for explaining an image forming apparatus according to the present invention.

FIG. 1 is a schematic cross sectional diagram showing an embodiment of an image forming apparatus of the present invention. The apparatus is a color image forming apparatus regarded as a copying machine or a laser printer using an electrophotographic process and consists of four independent image forming stations (image forming units) vertically juxtaposed as an image forming section.

This is because, if the four image forming units are configured to be juxtaposed horizontally, the installing area of the apparatus becomes larger and can not satisfy the requirement of the miniaturization of the apparatus used in office. Also, since the optical unit such as a laser scanner or the like is placed in an upper portion of a main body of the apparatus, there are some cases where it is difficult to have access with a sheet paper conveying path and expendable parts by opening the top face of the apparatus and also difficult to replace the toner and the photosensitive member. Moreover, an operating ability becomes poor at a time when the sheet paper is jammed.

Hence, in the present embodiment, as shown in FIG. 1, by juxtaposing the image forming stations vertically, a step is taken to reduce the installing area of the apparatus. Also, a jam clearance and a replaceability of expendable parts are improved by making the main body of the apparatus dividable components along a transfer material conveying path.

The four image forming units are in charge of, from the underside, for example, yellow (Y), magenta (M), cyanogen (C) and black (K) image formation and have rotary drum-shaped electrophotographic photosensitive members as image bearing members, that is photosensitive drums 11, 12, 13 and 14 respectively. These photosensitive drums 11 to 14 are formed with organic photoconductive layers (OPC photosensitive layers) as surface layers on basic members such as aluminum cylinders electrically grounded or the like. The photosensitive drums 11 to 14 are rotatively driven at a predetermined peripheral speed (a process speed) in the counter clockwise direction indicated by the arrow.

While in rotating, the surfaces of the photosensitive drums 11, 12, 13 and 14 are uniformly charged with the potential of the predetermined polarity (the negative polarity in the present embodiment) by respective primary charging rollers 21, 22, 23 and 24 and then receive image exposure based on image information through image exposure means 31, 32, 33 and 34, thereby forming electrostatic latent images corresponding to the first, the second, the third and the fourth color component images of intended color images, that is yellow, magenta, cyan and black component images.

Subsequently, the electrostatic latent images on the photosensitive drums 11, 12, 13 and 14 are developed with toners (toners of negative charged polarity) of each color by developing devices 41, 42, 43 and 44 and visualized as yellow, magenta, cyan and black toner images respectively. The developing devices 41 to 44 adopt a mono-component contact development and comprise developing rollers abutting against the photosensitive drums. The toners are thinly laid on the developing rollers and borne to developing portions where the latent images are developed by developing bias (negative voltage in the present embodiment) applied to the developing rollers. For the toner, the so-called non-magnetic toner containing no magnetic substance was used.

Along the moving direction of a transfer belt 8 as a transfer material bearing member for vertically (vertically upward) conveying the transfer material, four image forming units are arranged. The transfer belt 8 is set up by stretching around a driving roller 102 and two tension rollers 101 and rotatively driven at approximately the same peripheral speed as the photosensitive drums 11 to 14 in the counter clockwise direction indicated by the arrow.

In each of the image forming unit, transfer rollers 51, 52, 53 and 54 connected to high voltage power sources 51', 52', 53'and 54' (constant voltage power sources) as voltage applying means are set up and abut against nip portions (transfer portions) of the photosensitive drums 11, 12, 13 and 14 respectively from the back surface of the transfer belt 8. In the present embodiment, each of the transfer rollers 51 to 54 is formed into a solid rubber roller with a diameter of 12 mm and made of EPDM rubber with the value of resistance adjusted to $10^5$ Ωcm by black carbon. As will be described later, the value of resistance of each transfer roller is sufficiently smaller than the value of resistance of the transfer belt and, in each transfer portion, the value of resistance of each transfer roller can be ignored if viewed from the value of resistance of the transfer belt.

The transfer material fed from a sheet cassette (not shown), for example, a sheet of paper is supplied to the transfer belt 8 via a pair of registration roller (not shown) and, by applying an attractive current (refer to FIG. 2) by a high voltage power source (constant current power source) 70 between an attractive roller 7 as attractively charging means abutting against the transfer belt 8 and a roller 101 opposing to this, the transfer material is electrostatically charged and attracted on the surface of the transfer belt 8 in the nip portions (attracting portions) of the transfer belt 8 and conveyed vertically by the rotation of the transfer belt 8. Note that the configuration may be comprising a separation mechanism in which the attractive roller 7 is separated from the transfer belt except when the attracting process is performed for attracting the transfer material to the transfer belt. In this case, contaminants such as toners or the like attracted on the transfer belt are attracted on the attractive roller for some cause and the transfer material becoming dirty as a result can be prevented.

The attractive roller 7 is composed of a solid rubber formed on a core and the core is applied a high voltage bias for attraction. In the present embodiment, a solid rubber roller with a diameter of 12 mm formed from EPDM rubber with carbon black dispersed and resistance adjusted is employed. The value of resistance thereof is a value taken as $10^5\Omega$ at the time when a metallic foil with 1 cm in width is wound around the outer periphery of the roller and a voltage of 500 V is applied between the foil and the core. As will be described later, the valves of resistances of the attractive roller 7 and the opposing roller 101 is sufficiently smaller than the value of resistance of the transfer belt and, in the attractive portion, the values of resistances of the attractive roller 7 and the opposing roller 101 can be ignored in comparison with the value of resistance of the transfer belt.

The attractive bias is generated from a high voltage substrate by a signal determined by a CPU 74 as a controller based on the environment in which the main body of the apparatus is used and print conditions. When a predetermined attractive current is applied, the voltage (the voltage generated between the roller 101 and the attractive roller 7) necessary for letting the predetermined current to flow is detected by a voltmeter 73 as voltage detecting means and this detected result is converted into A/D by an A/D converter located on the high voltage substrate and monitored by the CPU.

The transfer material induced an electrostatic attractive force and conveyed to the transfer nip portion of the image forming unit of the first color at the lowest end by the transfer belt 8 is transferred with a yellow toner image of the first color on the photosensitive drum 11 by the transfer voltage (the positive voltage in the present embodiment) applied from the high voltage power source 51' to the transfer roller 51.

Hereinafter, every time the transfer material passes through the transfer nip of each image forming unit of the second, the third and the fourth color, a magenta toner image on the photosensitive drum 12, a cyan toner image on the photosensitive drum 13, a black toner image on the photosensitive drum 14 are sequentially transferred on the transfer material by laying on top of another, thereby a full color image superimposed with toner images of four colors of yellow, magenta, cyan and black can be obtained.

The transfer material in which the transferring of all colors is completed is separated from the top end of the transfer belt 8 by curvature of the transfer belt (self stripping), and the toner images are thermally fixed on the transfer material conveyed to a fixing device 9 (a pair of fixing rollers) and taken as a final print. After that, the transfer material is discharged outside of the apparatus.

The photosensitive drums 11, 12, 13 and 14 in which the transferring has completed receive cleaning by scraping off the residual toner remaining on the surface of each photosensitive drum with cleaning blades disposed in cleaning devices 61, 62, 63 and 64, thereby preparing for the following image formation.

Also, at the time of following the first side of the transfer material, the image formation (duplex image formation) is performed on the second side which is the reverse of the first side of the transfer material, two sides of the transfer material once passed through the fixing device 9 are reversed and the transfer material is conveyed again to the transfer belt 8 and the toner images of four colors are transferred on the second side of the transfer material put on the side of the photosensitive drums 11 to 14 in the similar manner as described above and then fixed by the fixing device 9.

In the present embodiment, for the transfer belt 8, an endless PVDF single layer resin belt with a thickness of 100 $\mu$m adjusted to $10^9$ Ωcm added with ion conductive agent was used. As for the volume resistivity of the transfer belt, it is preferable that it is set at $10^7$ to $10^{11}$ Ωcm in order to prevent that charging-up becomes excessive so that a transfer voltage becomes excessive and also for the reasons that a charge potential of the transfer belt can be decayed sufficiently by the time when the next image forming process begins even without eliminating a charge from the transfer belt after the transfer process is completed (since a charge eliminating mechanism for eliminating a charge from the transfer belt may not be separately provided, the miniaturization and simplification of the apparatus can be realized).

It is preferable to choose a belt wherein the volume resistivity of the transfer belt becomes larger than the volume resistivity of the transfer material and, as described above, in the present embodiment, a transfer belt with a volume resistivity of $10^9$ Ωcm is used.

The volume resistivity of this transfer belt is measured by a high resistance meter manufactured by ADVATEST corporation (Model R8340) with 100 V applied, and the value measured thereof is divided by a thickness of the belt and normalized. Note that the volume resistivity of the transfer material (sheet paper) or the like is also measured by the method defined here.

When such a transfer belt with a resistance adjustment made by ion conducting agent is adopted, since the transfer belt has a characteristic that the value of its resistance is easy to fluctuate as the moisture in the air is absorbed by the transfer belt, there is every possibility that a poor transferring is created. To put it more concretely, the volume resistivity of the transfer belt varies by about one order of magnitude between the low temperature and low humidity environment L/L (15° C./10%RH) and the high temperature and high humidity environment H/H (30° C./80%RH).

When a large fluctuation of resistance occurs in the transfer belt in this manner, a transfer charge (current) induced to the transfer material changes so that a poor transferring due to a lack of the current occurs in case of the L/L environment and a re-transfer phenomenon due to an electric discharge occurs in case of the H/H environment, thereby lowering the transfer efficiency (the transfer efficiency of the toner image from the photosensitive member to the transfer material) and causing uneven hues or tones.

Hence, in the present embodiment, a predetermined current is applied to the opposite roller 101 as a first contact member (at this time, the attractive roller 7 as a second contact member serves also as an opposite electrode of the opposite roller 101 and is configured so as to contact the transfer belt) and the voltage generated at this time between the terminals of the input side and the output side of a power source 70 (a supply voltage from the power source 70) is detected by a voltmeter 73. The detected result thereof is converted into an electrical signal and fed to the CPU. From this detected result, the value of resistance of the transfer belt 8 can be estimated (determined). Based on this detected result, the transfer voltage applied from respective power sources 51' to 54' to the transfer rollers 51 to 54 was allowed to be controlled. Hereinafter, a concrete example will be described.

In the present embodiment, when the value of resistance of the attractive roller 7 and the opposite roller 101 is compared to the value of resistance of the transfer belt, one value of resistances of the attractive roller and the opposite roller can be ignored. (This is because the volume resistivity of the attractive roller 7 and the opposite roller 101 is by one or more orders of magnitude smaller than that of the transfer belt.) Therefore, by detecting a voltage in a state where the opposite roller, the transfer belt and the attractive roller are connected in series, the resulting resistance of the transfer belt can be known.

Figure 2:
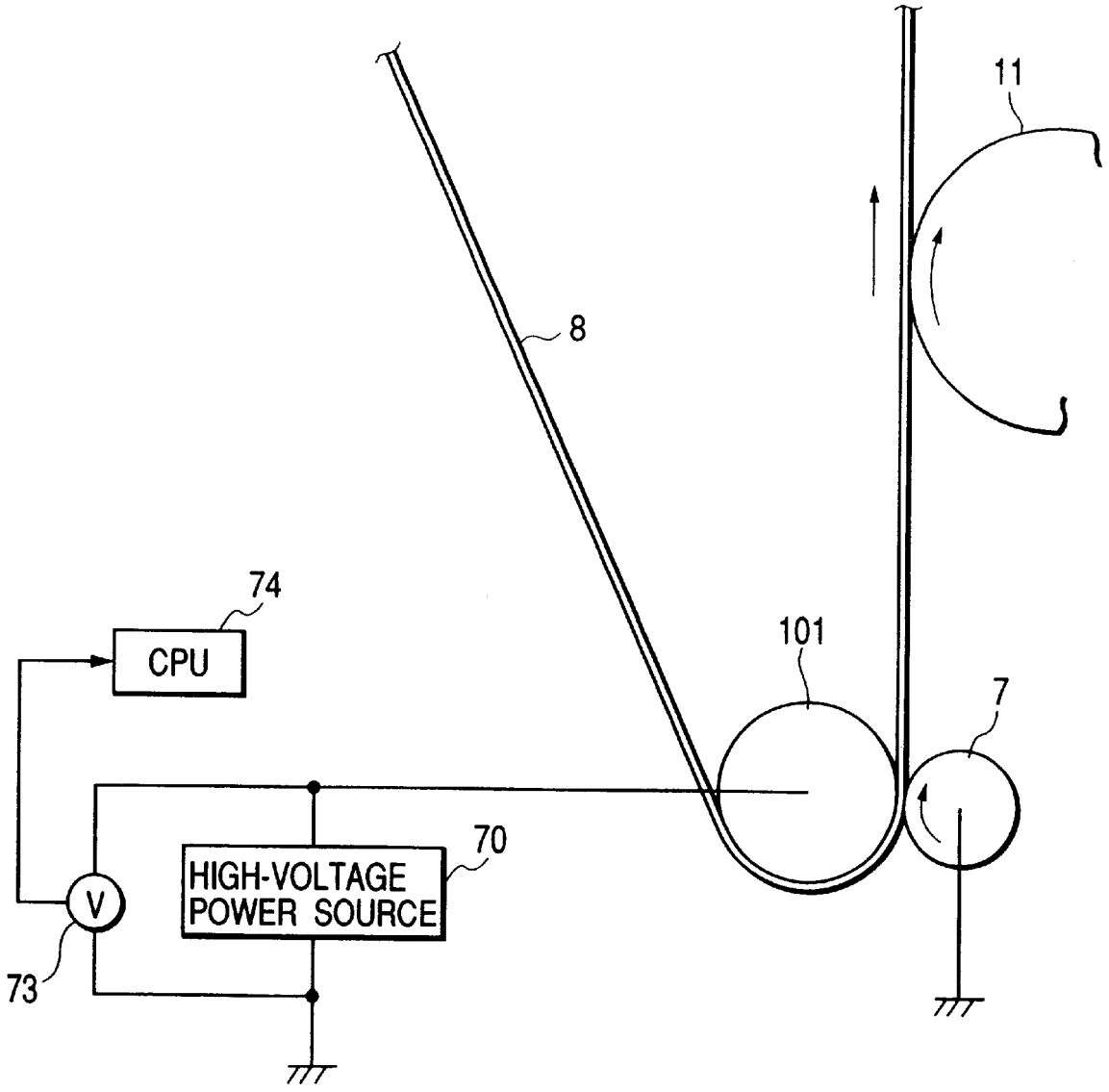
FIG. 2 is a diagram for explaining the detail of an attracting portion in FIG. 1.

At the time of the so-called initial rotation before the image formation is started, as shown in FIG. 2, a predetermined constant current is applied between the attractive roller 7 and the opposite roller 101 from the high voltage power source 70 (at this time, no transfer material exists between the transfer belt and the attractive roller) and the voltage applied (the voltage applied from the power source) between the opposite roller 101 and the attractive roller 7 via the transfer belt is detected by the voltmeter 73. At this time, the CPU compares the value of the detected voltage with the value of voltage stored by storing means such as a ROM and set in advance to give feedback to respective transfer voltages.

Since there exists the transfer belt 8 alone between the attractive roller 7 and the opposite roller 101, the relationship at this time of current-voltage exhibits the characteristic (resistance) of the transfer belt.

In the different environments of L/L, H/H, J/J (23° C./65%RH), when the voltage detected in case of applying the constant current value of 50 $\mu$A between the opposite roller 101 and the attractive roller 7 via the transfer belt is taken as V0 and optimum transfer voltage to be applied from the respective transfer power sources to the respective transfer rollers determined on the basis of the result of estimate of the image formed under the same environmental conditions as V1, the respective values are shown in Table 1. This optimum transfer voltage V1 is most efficient in the transfer efficiency when one side printing is performed with a sheet of paper (4024 sheet paper manufactured by Xerox Corporation, basic weight 74 g/m$^2$) left as it is in each environment and the voltage where no defective image is created.

TABLE 1

| | H/H | J/J | L/L |
|---|---|---|---|
| Detected voltage when controlled by 50 $\mu$A (V0) | 300 V | 500 V | 800 V |
| Optimum transfer voltage (V1) | 700 V | 1100 V | 1700 V |

As apparent from Table 1, it is found that optimum transferring can be performed by constant-voltage-controlling each transfer voltage at a value of V1 which is derived by adding 100 V to a value which is obtained by doubling the voltage V0 in the 50$\mu$A constant-current-control. That is, the following expression:

$$V1[V]=V0\times 2+100$$

can be established.

Also, when one side printing is performed in the case where the resistance of the above described sheet paper is relatively low, an optimum transfer efficiency was obtained by setting the transfer voltages of all four colors at V1. That is, the transferring was made excellently even without sequentially increasing the transfer voltage every time a transferring process was passed through.

Note that the reason why the constant voltage power source is adopted as the transfer power source is to prevent occurrence of the poor transferring due to a lack of the transfer current because, in the case where a toner image is transferred on the transfer material of small size with respect to a length in a crosswise direction of the transfer belt, a transfer current escapes to an outer non-sheet passing portion rather than a sheet passing portion.

In the present embodiment, the poor transferring created by the fluctuation of the value of resistance of the transfer belt due to a change in the environment is prevented. However, even when the variation in the value of resistance occurs at the time of the production of each transfer belt, occurrences of the poor transferring can be similarly prevented.

That is, as in the past, the image fault and the poor transferring occurred when the image transfer was performed always at a constant voltage regardless of a change in the environment came to be preventable. In other words, even when the resistance of the transfer belt becomes different from a design value due to the variation in the production, since the same behavior as the fluctuation in the value of resistance of the transfer belt due to a change in the environment is exhibited, these things can be dealt with by similar technique as described above.

Also, since the apparatus is configured such that, at the time of the so-called initial rotation before the transfer material reaches the transfer portion of the first image forming station, the above described voltage is detected at the attractive portion, a feedback can be given to the transfer voltage at the time of the transfer process in the first to fourth image forming stations. Therefore, the detected result can be immediately and sequentially reflected on the transfer voltage of the subsequent stations.

As described above, in the present embodiment, because the value of resistance of the transfer belt can be grasped by detecting the above described voltage at the attractive portion and the transfer voltage applied to each transfer roller from each transfer power source can be controlled by the CPU based on the above described detected voltage, the transfer efficiency of the toner image of each color can be optimized and improved and an excellent full color image without color heterogeneity (uneven hues or tones) can be obtained.

As another example of the above embodiment, instead of the opposite roller 101, a non-contact corona charger may be used for the transfer belt. In this case, the configuration may be such that a predetermined current is applied to the corona charger and the voltage (the power source voltage by which the power is supplied to the corona charger) produced between the corona charger and the attractive roller is detected.

On the other hand, instead of the attractive roller 7, the non-contact corona charger may be used for the transfer belt. In this case, the configuration may be such that a predetermined current is applied to this corona charger and the voltage (the power source voltage by which the power is supplied to the corona charger) generated between the corona charger and the opposite roller 101 is detected.

Figure 3:
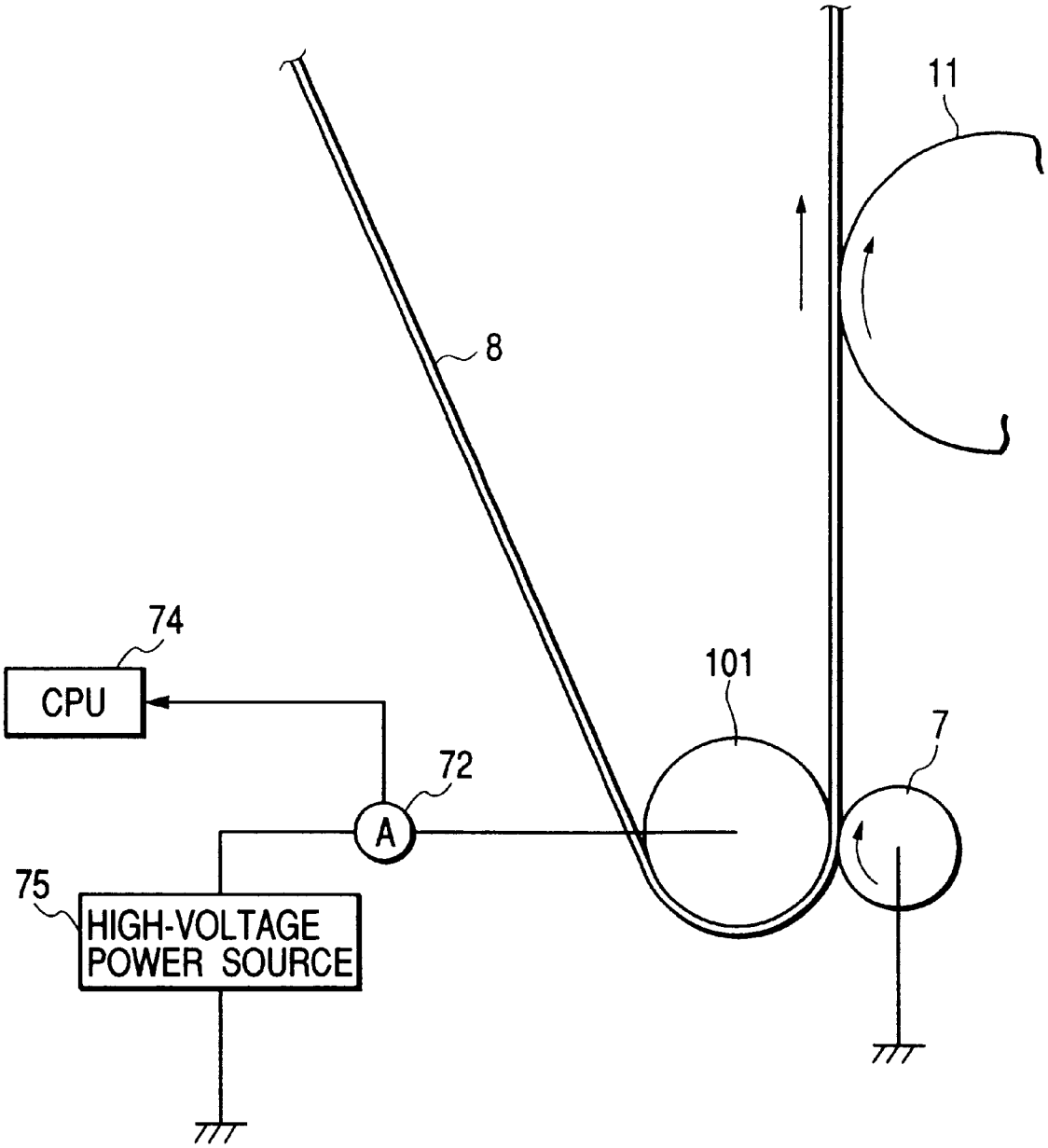
FIG. 3 is a diagram for explaining the detail of the attracting portion as another application example.

Also, in the above embodiment, the description was made for the example where the above described voltage is detected in the attractive portion. However, as shown in FIG. 3, the configuration may be such that a predetermined voltage is applied to the opposite roller 101 from the attractive power source (constant voltage power source) 75 and, at this time, the current (the current flowing from the power source to the opposite roller) flowing between the opposite roller 101 and the attractive roller 7 via the transfer belt is detected by an ammeter 72 and, based on this detected current, each transfer voltage is controlled by the CPU. At this time, the CPU is configured such that the detected current value is compared to the value of current stored by storage means such as the ROM or the like and set in advance and a feedback is given to each transfer voltage.

Also, instead of the attractive roller, an attractive brush or an attractive blade or the like may be used. Moreover, at the time of detection, the configuration may be such that a bias may be applied to the attractive roller.

(Embodiment 2)

The present embodiment is applicable to the image forming apparatus as described by referring to FIG. 1 and is configured to be approximately similar to the above described Embodiment 1. Hence, different aspects from the Embodiment 1 will be described as follows.

In the Embodiment 1, since each transfer voltage was controlled by detecting a voltage or a current at the attractive portion, the transferring of the toner image was performed excellently even when the fluctuation of resistance of the transfer belt occurred due to a production error and an environmental variation.

Figure 4:
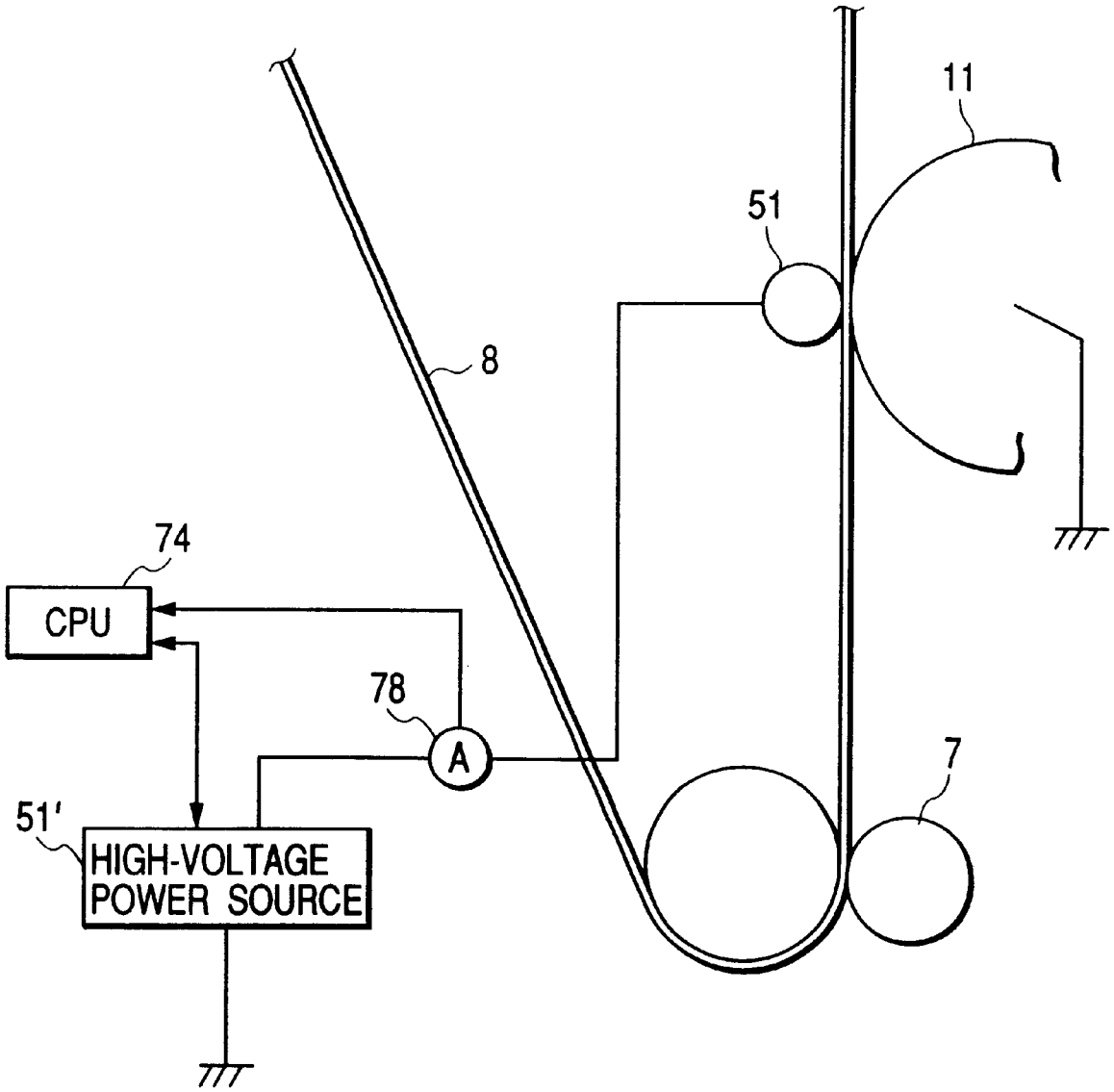
FIG. 4 is a diagram for explaining the detail of a transfer portion in FIG. 1.
Figure 5:
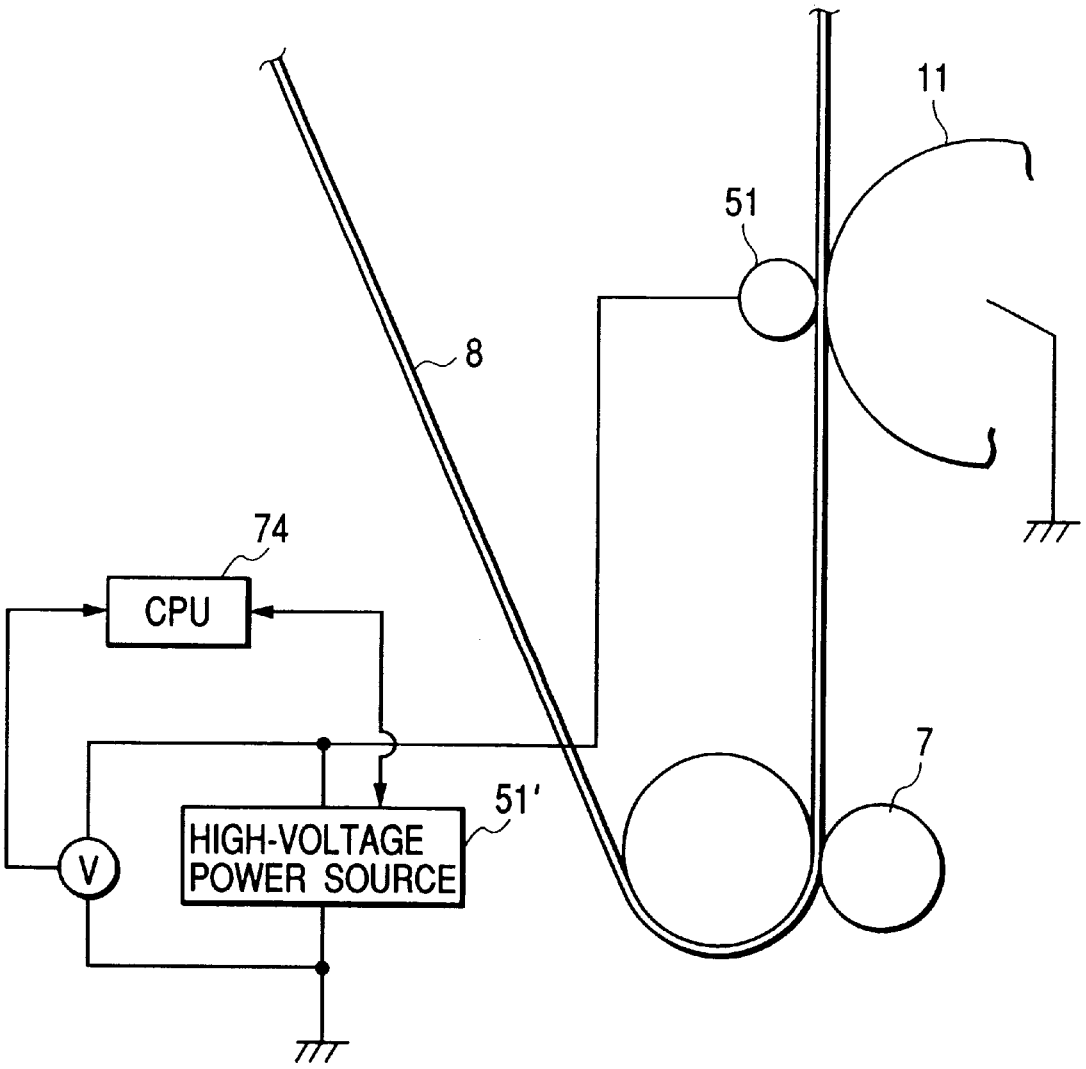
FIG. 5 is a diagram for explaining the detail of the transfer portion as another application example.

In contrast, however, in the present embodiment as shown in FIGS. 4, 5, the voltage or the current is detected at the transfer portion of the image forming station in the most upstream of the conveying direction of the transfer material, that is, a first image forming station so that a total value of resistance of the transfer roller 51, the transfer belt 8 and the photosensitive drum 11 is grasped, thereby determining the transfer voltage by the CPU based on this detected result.

The detection of the current or the voltage at the transfer portion of the first image forming station allows the detection accuracy to improve as the resistance of an object itself for which the feedback is performed can be grasped.

Now, the configuration of the transfer portion of each image forming station is such that the photosensitive drum, the transfer belt and the transfer roller are electrically connected in series, and in case of applying the voltage to the transfer roller, this voltage is borne (partially divided) by the transfer roller, the transfer belt and the photosensitive drum respectively, but since the value of resistance of the transfer rollers 51 to 54 as used in the present embodiment is $10^5\Omega$ as described above, one voltage bearing portion by the transfer roller can be nearly ignored.

However, the photosensitive drums 11 to 14 as OPC photosensitive members have charge transport layers (CT layers) as dielectric layers on the surfaces and exhibit the very high value of resistance. By rotatively moving while receiving a charge, the surface of the photosensitive drum acts as an impedance having a capacitance and can let the current flow. Its impedance value Z is determined by:

$$Z=1/\omega\cdot C=t/(S\cdot\in\cdot\in O)$$

(ω): a parameter relative to the movement of the photosensitive drum, S: the movement area per unit hour, ∈: relative dielectric constant, ∈O: dielectric constant in vacuum and t: a thickness of the CT layer) and is proportional to a thickness t of the CT layer.

Such being the case, when the surface is abraded as it endures, the impedance is reduced, thereby reducing the above described voltage bearing share of the photosensitive drum and the voltage borne by the transfer material is relatively increased more for that. For this reason, the toner image on the transfer material is transferred to the photosensitive drum again with a chance to reduce the transfer efficiency.

Hence, in the present embodiment, similar to the first embodiment, at the time of the so-called initial rotation before the image formation is started, a predetermined voltage is applied from the transfer power source 51' to the transfer roller 51 in a state where the transfer roller, the transfer belt and the photosensitive drum are electrically connected in series and, at this time, the current flowing from the transfer roller to the photosensitive drum via the transfer belt is detected and the signal indicating this detected current is fed to the CPU. The CPU determines the transfer voltage of each image forming station by comparing the detected current with the value of current stored in the storing means such as the ROM or the like and set in advance, that is, based on the detected current value.

In the image forming apparatus of the present embodiment, as the transfer material receives the transfer charge at the transfer portion and moves to the subsequent transfer portions of the downstream image forming stations, there are some cases where the transfer voltage required for the transfer of the toner image has to be set larger sequentially for each transfer.

This is attributable to the charging-up of the transfer belt and the transfer material due to the transfer charge. In the transfer portions of the subsequent (downstream) image forming stations, in the light of the charging-up of the transfer belt and the transfer material, unless the transfer voltage increased higher than the transfer voltage applied to the transfer portions of the upstream image forming stations is applied, nearly the same transfer current is sometimes unable to flow to each transfer portion.

In the present embodiment, since a belt with a relatively low resistance similar to that of the first embodiment is used as the transfer belt 8, the belt used is such that the charged up charge of the transfer belt in the transfer portion of a certain image forming station is decayed before it reaches the transfer portion of the next image forming station. Note that, depending on the environmental conditions, there are some cases where the charging-up of the transfer belt can not be ignored. This will be described hereinafter.

Because, depending on the type, there exist transfer materials with various values of resistance, they can be classified into those producing the charging-up and those capable of ignoring the charging-up. The film (light transmissive resin) for OHP (Over Head Projector) with a relatively high resistance and the sheet paper once passed through the fixing device and highly resistant owing to evaporation of the water content to be used at the time of the duplex image formation are hard to decay when a charge is induced by the transfer charging process and will sometimes affect the transfer process in the next image forming station.

From this, in the present embodiment, at the time of non-sheet feeding such as the time of the initial rotation, the current or the voltage was allowed to be detected in the transfer portion of the first image forming station (the value of resistance of the transfer belt was allowed to be detected). Based on this detected result and the information on the type of the transfer material obtained from a host computer connected to the image forming apparatus by a communication line or from users instructions, the transfer voltage was allowed to be controlled by the CPU in all the transfer portions.

Hereinafter, a concrete example will be described by referring to FIG. 4.

At the time of the so-called initial rotation before the image formation is started, a predetermined constant voltage, that is, 500 V is applied from the transfer power source 51' to the transfer roller 51 of the first image forming station and, at this time, the current flowing to the transfer roller 51, that is, the current flowing from the transfer roller to the photosensitive via the transfer belt is detected by the ammeter 78 (which allows to grasp the value of resistance of the transfer portion) and the signal indicating the value of the detected current converted under A/D conversion is fed to the CPU. This value of the detected current is a total of the impedance of the transfer roller 51, the transfer belt 8 and the photosensitive drum 11 connected in series.

Similar to the Embodiment 1, the CPU compares this detection signal with the value stored in the storing means such as the ROM or the like and set in advance and controls each transfer voltage required at the time of feeding the sheet. By such a configuration, the transfer bias control becomes possible, which does not depend on the environmental variation of the value of resistance of the transfer roller and the production error. However, in the present embodiment, by adequately changing the transfer bias of the subsequent stations in anticipation of the state of the transfer material to be used, more highly accurate bias control was allowed to be performed.

Depending on the information on the type of the transfer material obtained from the host computer, if the transfer material is such as having a high resistance easy to charge up, that is, an OHT film and the sheet paper once passed through the fixing device to be used at the time of the duplex image formation, the CPU adequately changes the transfer bias of each image formation station and sets the transfer bias to become sequentially larger as it moves to the downstream image forming stations and, as a result, controls approximately the same transfer current to flow to each transfer portion.

Giving an example of the case where the OHT film is fed, the OHT film is configured to have an antistatic layer by the method such as application or coating on a surface of a PET film and exhibits a high value of resistance close to an insulating material in a thickness direction and, when the transfer charge is received, this will sometimes influence till the downstream image forming stations.

Especially, when the impedance of the transfer portion is high, the charge decay of the OHT is inhibited and therefore it is preferable that the transfer voltage of the downstream image forming station is sufficiently increased than the transfer voltage of the upstream image forming station.

By making such a control, the poor transferring can be prevented and a full color image without color heterogeneity can be obtained.

Also, while the example of the detecting of the current in the transfer portion was shown as above, as shown in FIG. 5, the configuration may be such that the voltage is detected. That is, the current flowing between the transfer roller and the photosensitive drum via the transfer belt from the transfer power source is controlled so as to become the value of current essentially required for the transfer, that is, 4 $\mu$A and, at this time, the voltage generated in the transfer portion (transfer power source) is detected and, based on this detected voltage, the CPU determines the transfer voltage of each image forming station.

The transfer voltage essentially required for the transfer is given after substitution of $\in O=9.95\times10^{-12}$, $\in=3$, a process speed Vp=100 mm/second, an effective transfer width 1=200 mm, a thickness t of CT layer of OPC photosensitive layer=20 $\mu$m from $I=\in\times\in O\times Vp\times1/t$.

In Table 2, the relations between the voltage V0 detected at the time of initial rotation and the transfer voltages V11, V12, V13 and V14 of the first, the second, the third and the fourth station applied from each transfer power source to each transfer roller at the time of feeding the sheet is shown. These relations indicate the maximum transfer efficiency of each image forming station (the transfer efficiency of the toner image from the photosensitive member to the transfer material) and the value of the transfer voltage derived from an experiment where the image fault is not caused in the transfer portion.

TABLE 2

| V0 | V11 | V12 | V13 | V14 |
|---|---|---|---|---|
| 800 | 1300 | 1300 | 1300 | 1300 |
| 1200 | 1800 | 2000 | 2200 | 2400 |
| 1600 | 2300 | 2700 | 3100 | 3500 |
| 2000 | 2800 | 3400 | 4000 | 4600 |

As apparent from the table 2, when the value of resistance in the transfer portion is estimated to be low from the detected result, since the surface charge on the transfer belt and the OHT film received in the first image forming station is decayed, there is no need to increase the transfer voltage in the second station and subsequent stations. This is the same as the case of the one side print of the ordinary sheet paper as shown in the first embodiment.

On the other hand, when the film thickness of the OPC photosensitive layer is thick or the value of the resistance of the transfer portion (the transfer roller or the transfer belt) is estimated to be high from the detected result due to the L/L environment or the like, it is preferable that the transfer voltage of the first image forming station is set to be high and that the so-called sequential-up is performed for increasing the transfer voltage in the order from the upstream transfer portion to the downstream transfer portion in order to compensate for the lack of the transfer current in the transfer portion of the downstream image forming station due to the charging-up of the transfer material and the transfer belt.

The control of the transfer bias of the first image forming station and the amount of the sequential-up of the transfer bias is dictated by the information on the type of the transfer material determined from the host computer or users set-up and also by the information on the detected result at the time of the above described initial rotation and, by having several tables of the transfer bias as shown in Table 2 with the type of the transfer material and the detected result (equivalent to V0) combined, it became possible always to obtain optimum transfer conditions.

As described above, in the present embodiment, by measuring the impedance of the transfer portion including the photosensitive drum, the transfer belt, the transfer material and so on, it became possible to prevent the poor transferring for each station particular to the in-line apparatus.

Figure 6:
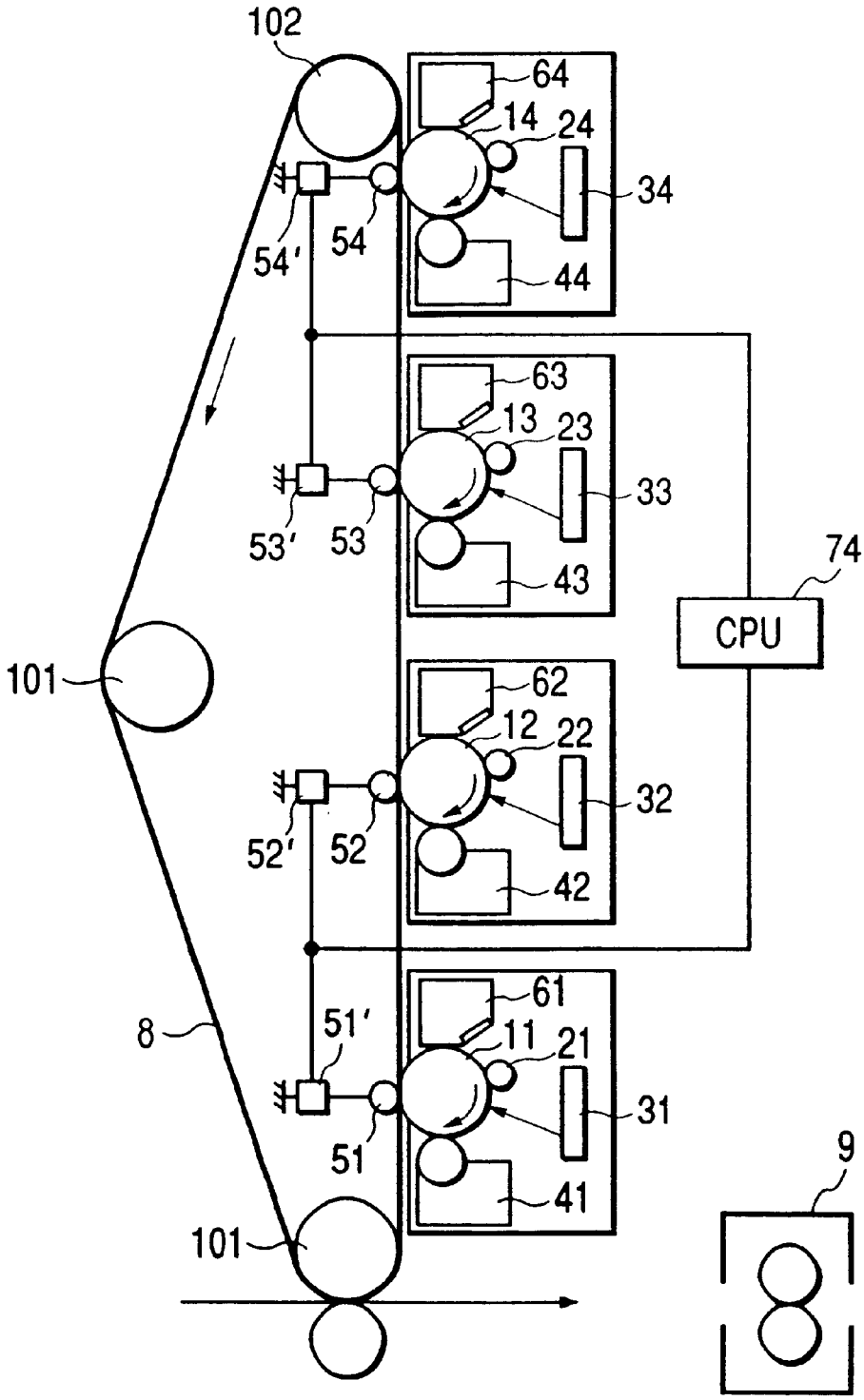
FIG. 6 is a schematic diagram for explaining the image forming apparatus according to the present invention.

Also, in the above, while the example of applying the present invention to the image forming apparatus of the in-line system having the transfer belt was described, the present invention can be also applied to the image forming apparatus having the intermediate transfer member as shown in FIG. 6. Note that, in FIG. 6, since the components designated by the same reference numerals as FIG. 1 have the same functions as those described in the above embodiment, the detailed explanation thereof will be omitted. Next, the image forming process of this image forming apparatus will be simply described.

In each image forming station arranged along the moving direction of an intermediate transfer belt 200 as the intermediate transfer member, the toner images of each color are formed on each photosensitive drum. The toner images of each color on each conventional drum are sequentially superimposed for a primary transfer onto the intermediate transfer belt at each of the primary transfer portions in the respective image forming stations. Note that the configuration of each primary transfer portion is the same as each transfer portion of each image forming station. Difference exist in that the transfer material does not pass through each primary transfer portion. A full color toner image on the intermediate transfer belt is conveyed to a secondary transfer portion and collectively transferred on the transfer material. After that, the full color image is thermally fixed on the transfer material by the fixing device and, by discharging the transfer material outside of the apparatus, a series of the image forming is brought to an end.

Figure 7:
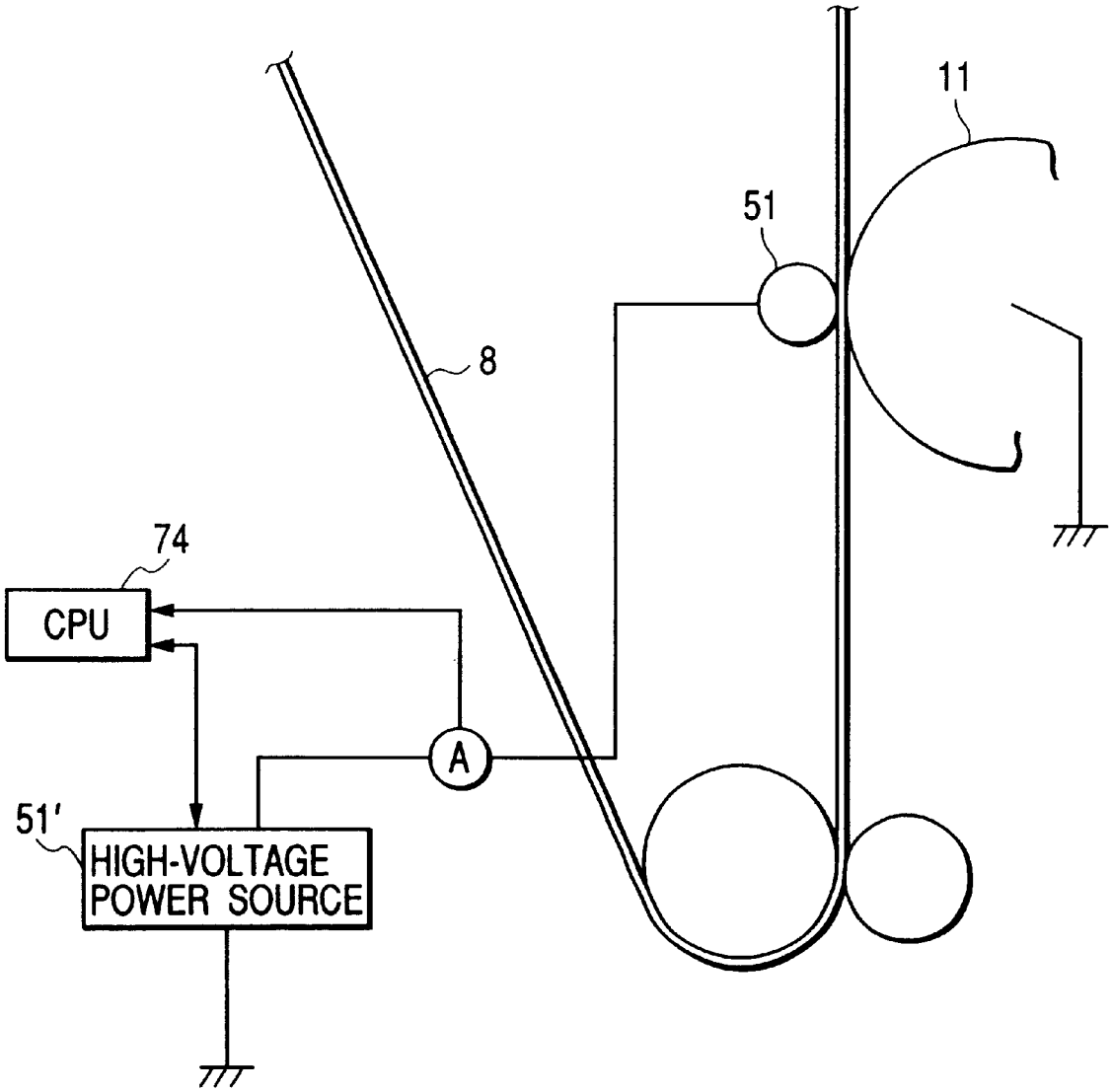
FIG. 7 is a diagram for explaining the detail of a primary transfer portion in FIG. 6.
Figure 8:
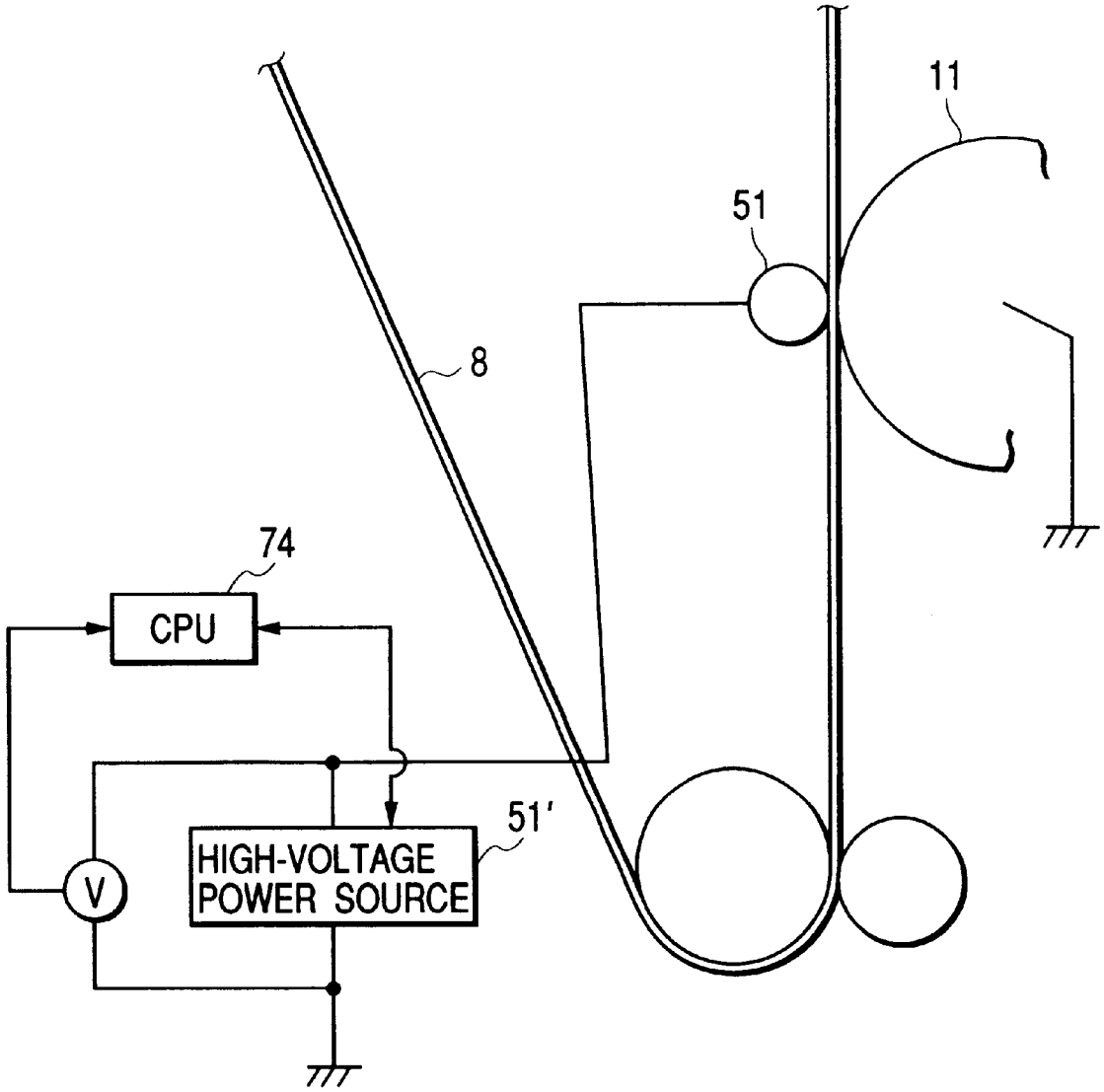
FIG. 8 is a diagram for explaining the detail of the primary transfer portion as another application example.

In such an image forming apparatus, as shown in FIGS. 7 and 8, the control including a detecting process can be performed in the same method as that of the above embodiment. That is, before the primary transfer is started (at the time of the so-called initial rotation or the like), a predetermined voltage or current is applied to the primary transfer portion and, by detecting the current flowing or the voltage generated at this time, the value of resistance of the intermediate transfer member can be estimated. Note that, at this time, based on this detected result, the CPU can control each primary transfer voltage (the sequential-up amount of the primary transfer voltage (the sequential-up amount sometimes comes to almost zero)) in each primary transfer portion and can form an excellent full color image without color heterogeneity on the intermediate transfer member with a result that an excellent full color toner image can be formed on the transfer material.

(Embodiment 3)

The present embodiment, similar to the above described Embodiments 1, 2 can be applied to the image forming apparatus of FIG. 1 and most of configurations are the same as those described in the Embodiments 1, 2 except for the following points. That is, in the present embodiment, in FIGS. 2, 3, 4 and 5, in the area of the transfer belt where the transfer material is borne, the present embodiment is characterized in that, similar to the Embodiments 1, 2, when a predetermined voltage or current is applied, a detecting process for detecting the voltage or the current is performed.

In the present embodiment, the voltage or the current was detected when a predetermined voltage or current was applied to the transfer portion in order to estimate the resistance of the photosensitive drum, the transfer belt, the transfer roller and the transfer material at the time of feeding the sheet, or the voltage or the current was detected when a predetermined voltage or current was applied to the attracting portion in order to estimate the resistance of the transfer belt and the transfer material and, based on this detected result, each transfer bias was allowed to be controlled.

In the case where the detection is performed in the transfer portion (FIGS. 4, 5), the current or the voltage is detected when a leading end of a non-image forming area (the so-called leading end margin) passes through the transfer portion of the first image forming station located at the most upstream end in the transfer material conveying direction. Based on this detected result, each transfer voltage applied to each transfer portion of the first to the fourth image forming stations was allowed to be controlled by the CPU immediately after the detection process.

In the case where the detection is performed in the attractive portion (FIGS. 2, 3), the current or the voltage is detected when the transfer material borne by the transfer belt passes through the attractive portion at the time before a leading end of the transfer material reaches the transfer portion of the first image forming station. Based on this detected result, the transfer voltage applied to each transfer portion of the first to the fourth image forming stations was allowed to be controlled by the CPU immediately after the detection process. In the detection process where the current or the voltage is detected, a timing for applying the predetermined voltage or current to the opposite roller 101 is preferable when the non-image forming portion, that is, the non-image forming portion (the blank portion) of the leading end or the trailing end of the transfer material (in the case where a length in the transfer material conveying direction is shorter than the distance between the attractive portion and the transfer portion of the first image forming station) passes through the attractive portion.

This is because, in the subsequent transfer process, the hysteresis of potential by application of the predetermined voltage or current is sometimes reflected on the image forming portion of the transfer material and, in such a case, occurrence of the poor transferring should be prevented.

By the way, due to the environmental variation, since the volume resistivity of the transfer material, especially the sheet paper is fluctuated from $10^6$ Ωcm to $10^{12}$ Ωcm, there exist some cases where the volume resistivity of the transfer material becomes larger than the volume resistivity of the transfer belt. Hence, in the present embodiment, different from the Embodiments 1, 2, by performing the detection process for detecting the current or the voltage at the time when the transfer material passes through, the resistance of the transfer material can be estimated as a result and it is now determined whether the transfer material is of the charging-up type or not. Consequently, based on the detected result, each transfer voltage in each subsequent transfer process can be excellently controlled by the CPU. Also, from this detected result, the CPU sequentially increases the transfer voltage required for performing an excellent image transfer on the transfer material every time it passes through the transfer process, or determines whether each transfer voltage should be approximately the same. In the present image forming apparatus also, similar to the above described Embodiments 1, 2, each transfer voltage to be applied based on a detected result is stored in advance in the ROM (Table value) as storing means and the CPU is configured to adequately choose the table value based on the detected result.

Also, in the case where the detected result obtained in the detection process performed when the first sheet of the transfer material passes through the transfer portion or the attractive portion after an image formation starting signal is inputted to the image forming apparatus is stored in the ROM as the storing means and the image formation is sequentially performed on a plurality of transfer materials, by controlling the transfer voltage at the time of transferring the toner image to the next second sheet of the transfer material, the transferring processes for the second sheet and subsequent sheets can be optimally performed without performing the detection process again as far as the type of the sheet paper is not changed.

In the case where the image formations are continuously performed on a plurality of transfer materials, whether the type of the sheet paper is changed halfway can be determined, for example, by using the information from means for detecting whether a feed cassette is attached to or detached from the apparatus or the information from the host computer on a change in the type of the transfer material.

Hereinafter, a concrete example of the controlling will be described with reference to FIG. 5.

When the blank portion of the leading end of the transfer material passes through the transfer portion of the first image forming station, a constant current of 4 μA is applied from the power source 51' to the transfer roller 51 and, at this time, the voltage (the supply voltage from the power source) generated across the input and the output terminals is detected. At this time, the transfer material borne by the transfer belt is in a state of abutting against the photosensitive drum.

Based on this detected result, the CPU controls the amount in which each transfer voltage, that is, the transfer voltage is sequentially increased every transfer process. The following Table 3 shows the transfer voltage to be applied based on the detected voltage V0 and, also, this value is stored in the ROM (table value) and the CPU is configured to choose the appropriate table value from the detected voltage V0. Note that numerals V11, V12, V13 and V14 denote the transfer voltages to be applied to each transfer portion of the first to the fourth image forming stations.

By performing such a detection and control process, even when the value of resistance of thee transfer material such as a sheet of paper made in China and a sheet of coated paper treated with surface finishing became larger than the transfer belt due to the environmental variation, an excellent toner image without color heterogeneity could be formed (transferred) without separately detecting a type of the transfer material.

Also, as shown in Table 3, when the detected voltage is small, each transfer voltage is not sequentially charged up, but kept remaining approximately the same transfer voltage. This is because, even when each transfer voltage is the same, it is possible to let approximately the same transfer current to flow in each transfer portion.

TABLE 3

| V0 | V11 | V12 | V13 | V14 |
|---|---|---|---|---|
| 800 | 1400 | 1400 | 1400 | 1400 |
| 1200 | 1900 | 2100 | 2300 | 2500 |
| 1600 | 2400 | 2800 | 3200 | 3600 |
| 2000 | 2900 | 3500 | 4100 | 4700 |

Also, after the above described control is performed, when the transfer material is fed to and borne by the transfer belt so that the image is formed on the next transfer material and as a result of having performed the above described detection process again, if the CPU determines that the current flowing in the each transfer portion of each image forming station does not reach the goal to be aimed at of 4 $\mu$A, it performs a feedback loop allowing to apply the transfer voltage increased further by 100 V than the transfer voltage as shown in Table 3 in each transfer portion, thereby making it possible to keep the transfer voltage properly adjusted.

As described above, in the present embodiment, even when the volume resistivity of the transfer material becomes larger than the volume resistivity of the transfer belt due to the environmental variation, each transfer voltage applied to each image forming station can be properly set. Consequently, the lowering of the transfer efficiency caused by the poor transferring can be prevented and a high quality image without color heterogeneity can be formed.

Also, the image forming apparatus is not limited to the configuration where, at the time of the above described sheet feeding, the voltage is detected and, based on this detected result, each transfer voltage is controlled, but another configuration (FIG. 4) does not offer any problem where, at the time of the sheet feeding, the current is detected and, from this detected result, each transfer voltage is controlled. Since the detecting method thereof is the same as that of the Embodiment 2, a detailed explanation will be omitted. Moreover, as shown in FIGS. 2, 3, the configuration is such that the voltage of the current is detected at the time of the sheet feeding in the attractive portion and, from this detected result, each transfer voltage may be controlled. The detecting method thereof is the same as that of the Embodiment 1 and, therefore, a detailed explanation will be omitted.

In the above embodiments, whichever embodiment it may be, the examples in which the conveying direction of the transfer material by the transfer belt is vertical or the conveying direction of the image by the intermediate transfer member is vertical were described. However, being not limited to this, the above direction may be horizontal.

What is claimed is:

1. An image forming apparatus, comprising:

a transfer material bearing member for bearing a transfer material;

a first image bearing member and a second image bearing member sequentially disposed along a conveying direction of the transfer material borne by said transfer material bearing member and for bearing images of different colors, respectively;

first voltage applying means and second voltage applying means for applying a first voltage and a second voltage, respectively, to said transfer material bearing member so that the images on said first image bearing member and said second image bearing member are sequentially superimposed and transferred on the transfer material borne by said transfer material bearing member;

detecting means for detecting a current flowing through said transfer material bearing member when a predetermined voltage is applied to an area, on which the transfer material is borne, of said transfer material bearing member before an image transfer is started; and control means for controlling said first voltage and said second voltage based on a detected result of said detecting means.

2. The image forming apparatus according to claim 1, wherein said control means controls a difference between said first voltage and said second voltage based on the detected result of said detecting means.

3. The image forming apparatus according to claim 2, wherein said control means controls the difference between said first voltage and said second voltage based on a type of the transfer material.

4. The image forming apparatus according to claim 3, wherein, when the transfer material is of a light transmissive resin, an absolute value of said second voltage is higher than an absolute value of said first voltage.

5. The image forming apparatus according to claim 2, wherein, an image transferred on a first side of the transfer material is thermally fixed, and thereafter an image is transferred on a second side opposite to the first side of the transfer material borne by said transfer material bearing member, when an absolute value of said second voltage is higher than an absolute value of said first voltage.

6. The image forming apparatus according to claim 2, wherein the difference between said first voltage and said second voltage is zero.

7. The image forming apparatus according to any one of claims 1 to 6, wherein said detecting means detects the current flowing through said transfer material bearing member when said predetermined voltage is applied to said transfer material bearing member by said first voltage applying means.

8. The image forming apparatus according to claim 7, wherein said detecting means detects the current flowing through said transfer material bearing member when said predetermined voltage is applied by said first voltage applying means to an area, on which a non-image forming portion of a leading end of the transfer material is borne, of said transfer material bearing member.

9. The image forming apparatus according to claim 8, wherein said control means controls said first voltage and said second voltage applied to an area, on which an image forming portion of the transfer material is borne, of said transfer material bearing member based on the detected result of said detecting means.

10. The image forming apparatus according to any one of claims 1 to 6, further comprising attractive charging means for attracting the transfer material to said transfer material bearing member, wherein said detecting means detects the current flowing through said transfer material bearing member when said predetermined voltage is applied by said attractive charging means to an area, on which the transfer material is borne, of said transfer material bearing member.

11. The image forming apparatus according to any one of claims 1 to 6, wherein said first voltage and said second voltage are constant-voltage-controlled.

12. An image forming apparatus comprising:

a transfer material bearing member for bearing a transfer material;

a first image bearing member and a second image bearing member sequentially disposed along a conveying direction of the transfer material borne by said transfer material bearing member and for bearing images of different colors, respectively;

first voltage applying means and second voltage applying means for applying a fist voltage and a second voltage, respectively, to said transfer material bearing member so that the images on said first image bearing member and said second image bearing member are sequentially superimposed and transferred on the transfer material borne by said transfer material bearing member;

detecting means for detecting a voltage generated when a predetermined current is applied to an area, on which the transfer material is borne, of said transfer material bearing member before an image transfer is started; and control means for controlling said first voltage and said second voltage based on a detected result of said detecting means.

13. The image forming apparatus according to claim 12, wherein said control means controls a difference between said first voltage and said second voltage based on the detected result of said detecting means.

14. The image forming apparatus according to claim 13, wherein said control means controls the difference between said first voltage and said second voltage based on a type of the transfer material.

15. The image forming apparatus according to claim 14, wherein when the transfer material is of a light transmissive resin, an absolute value of said second voltage is higher than an absolute value of said first voltage.

16. The image forming apparatus according to claim 13, wherein an image transferred on a first side of the transfer material is thermally fixed, and thereafter an image is transferred on a second side opposite to the first side of the transfer material borne by said transfer material bearing member, when an absolute value of said second voltage is higher than an absolute value of said first voltage.

17. The image forming apparatus according to claim 13, wherein the difference between said first voltage and said second voltage is zero.

18. The image forming apparatus according to any one of claims 12 to 17, wherein said detecting means detects the voltage generated when said predetermined current is applied to said transfer material bearing member by said first voltage applying means.

19. The image forming apparatus according to claim 18, wherein said detecting means detects the voltage generated when said predetermined current is applied by said first voltage applying means to an area, on which a non-image forming portion of a leading end of the transfer material is borne, of said transfer material bearing member.

20. The image forming apparatus according to claim 19, wherein said control means controls said first voltage and said second voltage applied to an area, on which an image forming portion of the transfer material is borne, of said transfer material bearing member based on the detected result of said detecting means.

21. The image forming apparatus according to any one of claims 12 to 17, further comprising attractive charging means for attracting the transfer material to said transfer material bearing member, wherein said detecting means detects the voltage generated when said predetermined current is applied by said attractive charging means to an area, on which the transfer material is borne, of said transfer material bearing member.

22. The image forming apparatus according to any one of claims 12 to 17, wherein said first voltage and said second voltage are constant-voltage-controlled.

23. An image forming apparatus, comprising:

a transfer material bearing member for bearing a transfer material;

a first image bearing member and a second image bearing member sequentially disposed along a conveying direction of the transfer material borne by said transfer material bearing member and for bearing images of different colors, respectively;

first voltage applying means and second voltage applying means for applying a first voltage and a second voltage, respectively, to said transfer material bearing member so that the images on said first image bearing member and said second image bearing member are sequentially superimposed and transferred on the transfer material borne by said transfer material bearing member;

detecting means for detecting a current flowing through said transfer material bearing member when a predetermined voltage is applied to an area, on which the transfer material is not borne, of said transfer material bearing member before an image transfer is started; and control means for controlling said first voltage and said second voltage based on a detected result of said detecting means.

24. The image forming apparatus according to claim 23, wherein said control means controls a difference between said first voltage and said second voltage based on the detected result of said detecting means.

25. The image forming apparatus according to claim 24, wherein said control means controls the difference between said first voltage and said second voltage based on a type of the transfer material.

26. The image forming apparatus according to claim 25, wherein when the transfer material is of a light transmissive resin, an absolute value of said second voltage is higher than an absolute value of said first voltage.

27. The image forming apparatus according to claim 24, wherein an image transferred on a first side of the transfer material is thermally fixed, and thereafter an image is transferred on a second side opposite to the first side of the transfer material borne by said transfer material bearing member, when an absolute value of said second voltage is higher than an absolute value of said first voltage.

28. The image forming apparatus according to claim 24, wherein the difference between said first voltage and said second voltage is zero.

29. The image forming apparatus according to any one of claim 23 to claim 28, wherein said detecting means detects the current flowing through said transfer material bearing member when said predetermined voltage is applied to said transfer material bearing member by said first voltage applying means.

30. The image forming apparatus according to any one of claims 23 to 28, further comprising attractive charging means for attracting the transfer material to said transfer material bearing member, wherein said detecting means detects the current flowing through said transfer material bearing member when said predetermined voltage is applied by said attractive charging means to an area, on which the transfer material is not borne, of said transfer material bearing member.

31. The image forming apparatus according to any one of claims 23 to 28, wherein said first voltage and said second voltage are constant-voltage-controlled.

32. An image forming apparatus comprising:

a transfer material bearing member for bearing a transfer material;

a first image bearing member and a second image bearing member sequentially disposed along a conveying direction of the transfer material borne by said transfer material bearing member and for bearing images of different colors, respectively;

first voltage applying means and second voltage applying means for applying a first voltage and a second voltage, respectively, to said transfer material bearing member so that the images on said first image bearing member and said second image bearing member are sequentially superimposed and transferred on the transfer material borne by said transfer material bearing member;

detecting means for detecting a voltage generated when a predetermined current is applied to an area, on which the transfer material is not borne, of said transfer material bearing member before an image transfer is started; and control means for controlling said first voltage and said second voltage based on a detected result of said detecting means.

33. The image forming apparatus according to claim 32, wherein said control means controls a difference between said first voltage and said second voltage based on the detected result of said detecting means.

34. The image forming apparatus according to claim 33, wherein said control means controls the difference between said first voltage and said second voltage based on a type of the transfer material.

35. The image forming apparatus according to claim 33, wherein, when the transfer material is of a light transmissive resin, an absolute value of said second voltage is higher than an absolute value of said first voltage.

36. The image forming apparatus according to claim 33, wherein an image transferred on a first side of the transfer material is thermally fixed, and thereafter an image is transferred on a second side opposite to the first side of the transfer material borne by said transfer material bearing member, when an absolute value of said second voltage is higher than an absolute value of said first voltage.

37. The image forming apparatus according to claim 33, wherein the difference between said first voltage and said second voltage is zero.

38. The image forming apparatus according to any one of claims 32 to 37, wherein said detecting means detects the current flowing through said transfer material bearing member when said predetermined current is applied to said transfer material bearing member by said first voltage applying means.

39. The image forming apparatus according to any one of claims 32 to 37, further comprising attractive charging means for attracting the transfer material to said transfer material bearing member, wherein said detecting means detects the voltage generated when said predetermined current is applied by said attractive charging means to an area, on which the transfer material is not borne, of said transfer material bearing member.

40. The image forming apparatus according to any one of claims 32 to 37, wherein said first voltage and said second voltage are constant-voltage-controlled.

41. An image forming apparatus, comprising:

an intermediate transfer member;

a first image bearing member and a second image bearing member sequentially disposed along a moving direction of said intermediate transfer member and for bearing images of different colors, respectively; and first voltage applying means and second voltage applying means for applying a first voltage and a second voltage respectively to said intermediate transfer member so that the images on said first image bearing member and said second image bearing member are sequentially superimposed and transferred on said intermediate transfer member;

wherein an image on said intermediate transfer member is transferred on a transfer material;

detecting means for detecting a current flowing through said intermediate transfer member when a predetermined voltage is applied to said intermediate transfer member before transferring of the images from said first image bearing member and said second image bearing member to said intermediate transfer member is started; and control means for controlling said first voltage and said second voltage based on a detected result of said detecting means.

42. The image forming apparatus according to claim 41, wherein said control means controls a difference between said first voltage and said second voltage based on the detected result of said detecting means.

43. The image forming apparatus according to claim 42, wherein said detecting means detects the current flowing through said intermediate transfer member when said predetermined voltage is applied to said intermediate transfer member by said first voltage applying means.

44. The image forming apparatus according to any one of claims 41 to 43, wherein said first voltage and said second voltage are constant-voltage-controlled.

45. An image forming apparatus, comprising:

an intermediate transfer member;

a first image bearing member and a second image bearing member sequentially disposed along a moving direction of said intermediate transfer member and for bearing images of different colors, respectively;

first voltage applying means and second voltage applying means for applying a first voltage and a second voltage respectively to said intermediate transfer member so that the images on said first image bearing member and said second image bearing member are sequentially superimposed and transferred on said intermediate transfer member;

wherein an image on said intermediate transfer member is transferred on a transfer material;

detecting means for detecting a voltage generated when a predetermined current is applied to said intermediate transfer member before transferring of the images from said first image bearing member and said second image bearing member to said intermediate transfer member is started; and control means for controlling said first voltage and said second voltage based on a detected result of said detecting means.

46. The image forming apparatus according to claim 45, wherein said control means controls a difference between said first voltage and said second voltage based on the detected result of said detecting means.

47. The image forming apparatus according to claim 46, wherein said detecting means detects the voltage generated when said predetermined current is applied to said intermediate transfer member by said first voltage applying means.

48. The image forming apparatus according to any one of claims 45 to 47, wherein said first voltage and said second voltage are constant-voltage-controlled.

49. An image forming apparatus, comprising:

an image bearing member for bearing an image;

a transfer material bearing member for bearing a transfer material;

voltage applying means for applying a voltage to said transfer material bearing member so that the image on said image bearing member is transferred on the transfer material borne by said transfer material bearing member;

detecting means for detecting a current flowing through said transfer material bearing member when a predetermined voltage is applied to an area, on which the transfer material is borne, of said transfer material bearing member before an image transfer is started; and control means for controlling the voltage to be applied from said voltage applying means to said transfer material bearing member based on a detected result of said detecting means.

50. An image forming apparatus, comprising:

an image bearing member for bearing an image;

a transfer material bearing member for bearing a transfer material;

voltage applying means for applying a voltage to said transfer material bearing member so that the image on said image bearing member is transferred on the transfer material borne by said transfer material bearing member;

detecting means for detecting a voltage generated when a predetermined current is applied to an area, on which the transfer material is borne, of said transfer material bearing member before an image transfer is started; and control means for controlling the voltage to be applied from said voltage applying means to said transfer material bearing member based on a detected result of said detecting means.

* * * * *

UNITED STATES PATENT AND TRADEMARK OFFICE

CERTIFICATE OF CORRECTION

PATENT NO. : 6,477,339 B1
DATED : November 5, 2002
INVENTOR(S) : Hideyuki Yano et al.

It is certified that error appears in the above-identified patent and that said Letters Patent is hereby corrected as shown below:

Column 2,
Line 49, “above described” should read -- above-described --.

Column 3,
Line 33, “cross sectional” should read -- cross-sectional --.
Line 42, “can not” should read -- cannot --.

Column 7,
Line 56, “above described” should read -- above-described --.

Column 8,
Lines 22 and 30, “above described” should read -- above-described --.
Lines 33 and 54, “above described” should read -- above-described --.

Column 9,
Line 8, “above” should read -- above- --.
Line 55, “above described” should read -- above-described --.

Column 10,
Line 31, “can not” should read -- cannot --.

Column 12,
Line 33, “above described” should read -- above-described --.
Line 65, “Difference” should read -- Differences --.

Column 13,
Line 25, “above described” should read -- above-described --.

Column 14,
Line 31, “above described” should read -- above-described --.

Column 15,
Lines 33, 36 and 54, “above described” should read -- above-described --.

UNITED STATES PATENT AND TRADEMARK OFFICE

CERTIFICATE OF CORRECTION

PATENT NO. : 6,477,339 B1
DATED : November 5, 2002
INVENTOR(S) : Hideyuki Yano et al.

It is certified that error appears in the above-identified patent and that said Letters Patent is hereby corrected as shown below:

Column 17,
Lines 9 and 19, “borne,” should read -- borne --.

Signed and Sealed this

First Day of July, 2003

JAMES E. ROGAN
*Director of the United States Patent and Trademark Office*